US006471433B1

(12) United States Patent
Lee

(10) Patent No.: US 6,471,433 B1
(45) Date of Patent: Oct. 29, 2002

(54) PEN HAVING A 3-DIMENSIONAL PATTERN THEREON

(75) Inventor: Ching-Huang Lee, Sanchung (TW)

(73) Assignee: Ding Area Enterprice Co., Ltd., Sanchung (TW)

( * ) Notice: Subject to any disclaimer, the term of this patent is extended or adjusted under 35 U.S.C. 154(b) by 0 days.

(21) Appl. No.: 09/919,109

(22) Filed: Jul. 31, 2001

(51) Int. Cl.[7] ..... B43K 23/008; G09F 19/00

(52) U.S. Cl. ..... 401/195; 15/443; 16/430; 16/902; 40/334; 40/905; 401/6; 401/88; 401/98; 401/243; D19/47

(58) Field of Search ..... 401/6, 52, 88, 401/98, 195, 243; 40/334, 905; 15/443; 16/430, 902; D19/47–50

(56) References Cited

U.S. PATENT DOCUMENTS

| | | | | | |
|---|---|---|---|---|---|
| 1,262,788 | A | * | 4/1918 | Heidenreich | 40/334 |
| 1,387,625 | A | * | 8/1921 | Stein | 40/334 |
| 1,421,535 | A | * | 7/1922 | Murdock | 401/88 |
| 1,961,460 | A | | 6/1934 | Slatis | 40/334 |
| 2,896,348 | A | | 7/1959 | Herne | 40/905 X |
| 3,250,033 | A | * | 5/1966 | Siegel | 401/195 X |
| 4,381,615 | A | * | 5/1983 | Lonsmin | 40/334 |
| 4,911,569 | A | * | 3/1990 | Hashimoto et al. | 401/6 X |
| 4,926,525 | A | | 5/1990 | Eylers | 24/11 F |
| 5,186,562 | A | | 2/1993 | Yoshinaga et al. | 401/195 X |
| D356,113 | S | | 3/1995 | Maggio | 401/195 X |
| 5,735,592 | A | | 4/1998 | Shu | 401/195 X |
| 6,019,536 | A | | 2/2000 | Lee | 401/195 |

FOREIGN PATENT DOCUMENTS

| | | | | |
|---|---|---|---|---|
| DE | 3406522 | * | 9/1985 | 401/6 |
| FR | 606124 | | 6/1926 | 401/88 |
| FR | 770358 | | 9/1934 | 401/98 |
| FR | 2622512 | * | 5/1989 | 401/6 |

* cited by examiner

*Primary Examiner*—David J. Walczak
*Assistant Examiner*—Kathleen J. Prunner
(74) *Attorney, Agent, or Firm*—Alan Kamrath; Rider, Bennett, Egan & Arundel, LLP

(57) ABSTRACT

A pen having a 3-dimensional pattern has at least one flexible strip. The flexible strip is sandwiched between a pattern ring and a liner ring with the 3-dimensional pattern partially protruding out of the pattern ring from a corresponding through hole. The liner ring abuts a bottom end of a connecting ring. The connecting ring is formed with an annular flange on its outer surface. The pattern ring abuts the annular flange to enclose the liner ring. A top end of the connecting ring is clamped onto a barrel of the pen, and a bottom end of the liner ring is threadingly connected to a tip of the pen.

1 Claim, 3 Drawing Sheets

PEN HAVING A 3-DIMENSIONAL PATTERN THEREON

BACKGROUND OF THE INVENTION

1. Field of the Invention

The present invention relates to the field of forming a pattern on a pen, and more particularly to the field of forming a 3-dimensional pattern on a pen.

2. Description of Related Art

U.S. Pat. No. 6,019,536, which is hereby incorporated herein, relates to a pen having a 3-dimensional pattern thereon. The pen has a cap with an aperture defined in a sidewall of the cap and the aperture is configured to correspond to the 3-dimensional pattern. The 3-dimensional pattern is formed on a flexible strip. The flexible strip is attached to an inside surface of the cap with the 3-dimensional pattern protruding out of the cap from the aperture. A liner ring is disposed in the cap to sandwich the flexible strip between the cap and the liner ring and thus provides secure attachment of the flexible strip to the inside surface of the cap.

However, the 3-dimensional pattern is formed on the cap or the barrel of the pen, and the applicant further improves the invention by adding a pattern ring onto the pen, and a 3-dimensional pattern can be formed on the pattern ring.

SUMMARY OF THE INVENTION

The objective of the present invention is to provide a pen having a 3-dimensional pattern thereon such that the 3-dimensional pattern is able to be decorative and provides commercial meanings.

Another objective of the present invention is to provide a pen having a 3-dimensional pattern thereon and of which the 3-dimensional pattern is formed on a pattern ring added to the pen.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
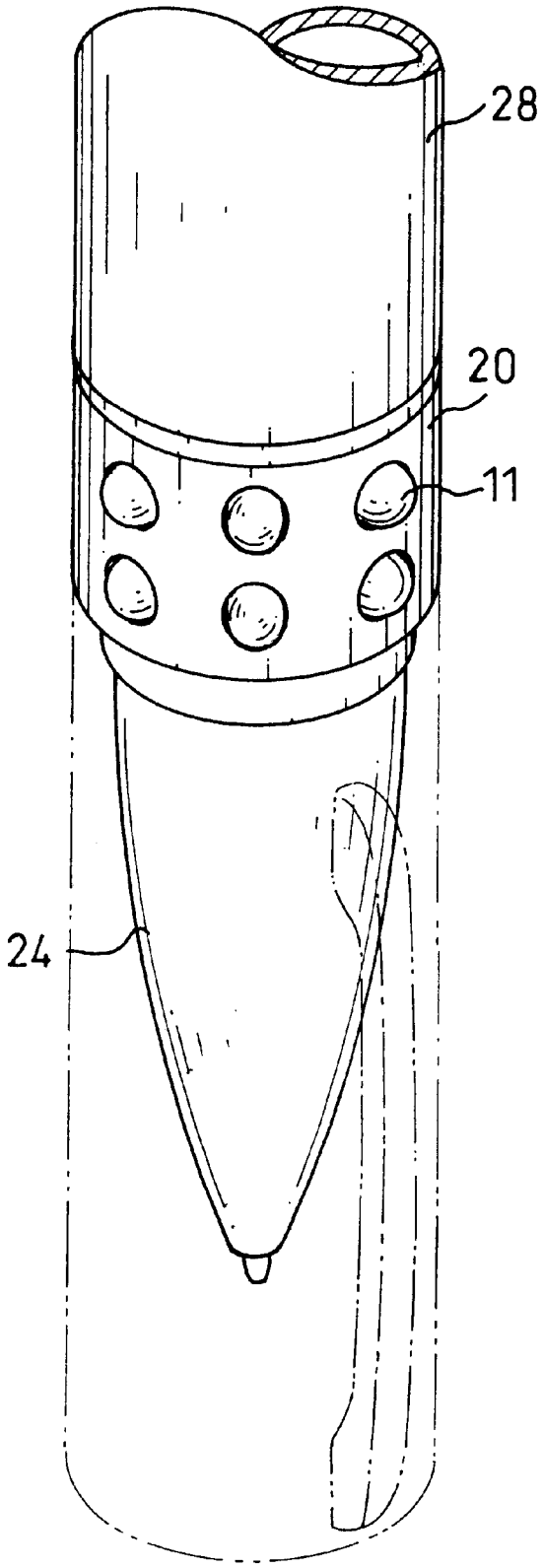
FIG. 1 is a perspective, partial view of a pen having a 3-dimensional pattern thereon in accordance with the present invention.

With reference to FIG. 1, a pen having a 3-dimensional pattern (11) in accordance with the present invention is shown. The pen has the 3-dimensional pattern (11) protruding from a pattern ring (20) disposed between a tip (24) and a barrel (28) of the pen.

Figure 2:
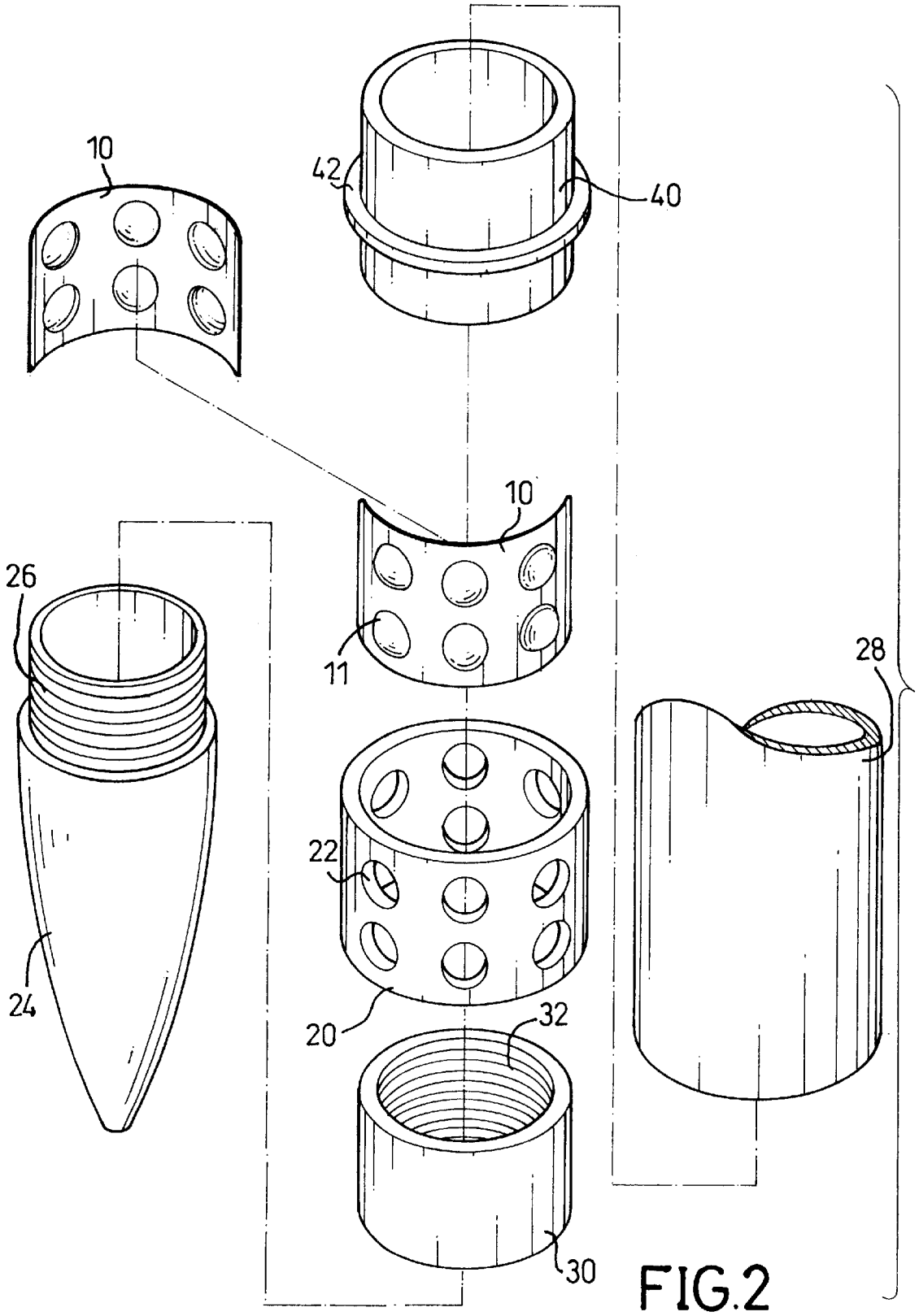
FIG. 2 is an exploded, perspective, partial view of the pen.
Figure 3:
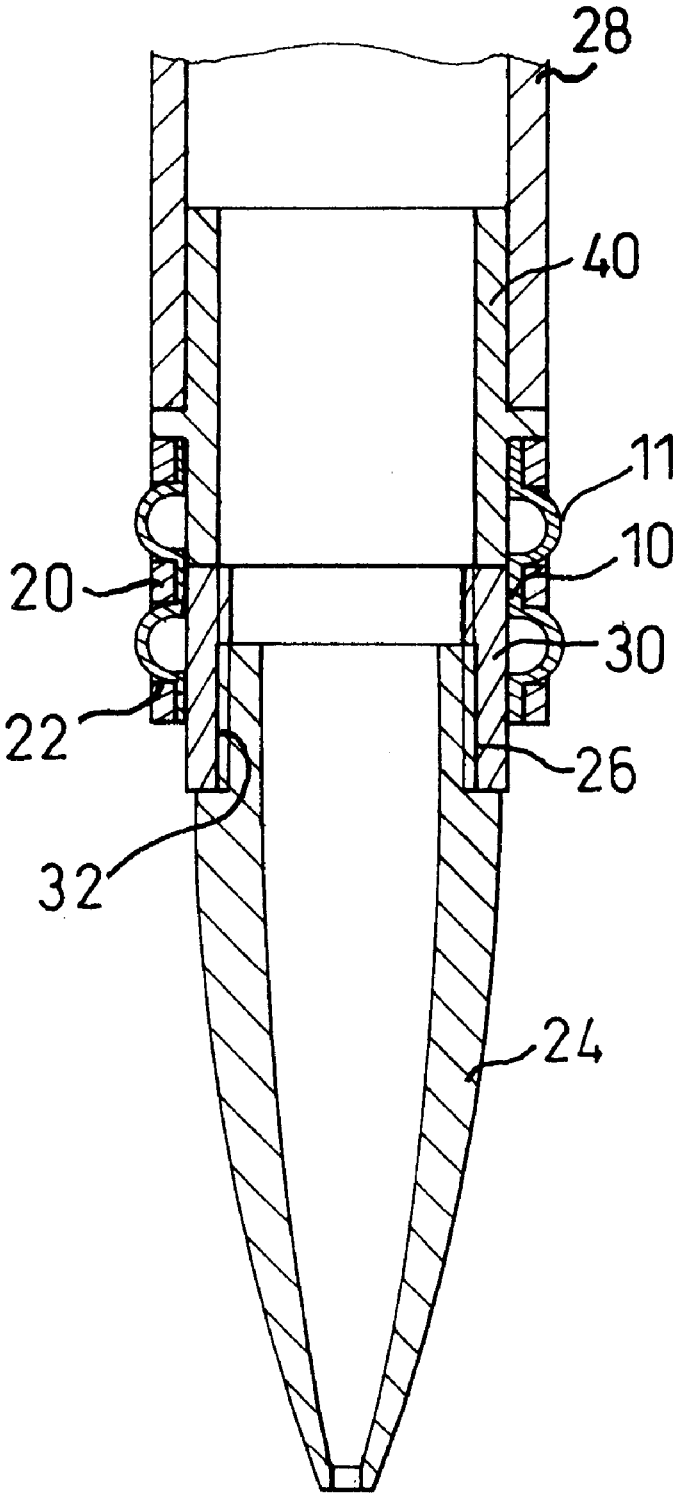
FIG. 3 is a cross-sectional, partial view of the assembled pen.

With reference to FIGS. 2 and 3, the 3-dimensional pattern (11) is formed on at least one flexible strip (10) (two strips (10) are shown in FIG. 2 as an example) which is disposed within the pattern ring (20). The pattern ring (20) has at least one through hole (22) corresponding to the 3-dimensional pattern (11) to allow the 3-dimensional pattern (11) to partially protrude out of the through hole (22). A liner ring (30) with an outer diameter slightly smaller than an inner diameter of the pattern ring (20) is provided to sandwich and secure the flexible strip (10) between the pattern and liner rings (20, 30). A connecting ring (40) has a top portion and a bottom portion divided by an annular flange (42) formed around an outer surface of the connecting ring (40). The bottom portion of the connecting ring (40) has an outer diameter slightly smaller than the inner diameter of the pattern ring (20) and thus can be force fitted into the pattern ring (20) with the annular flange (42) abutting a top surface of the pattern ring (20) to enclose the liner ring (30). The barrel (28) with an inner diameter slightly smaller than an outer diameter of the top portion of the connecting ring (40), is then clamped onto a top end of the connecting ring (40) by force fitting the top portion of the connecting ring into the barrel (28). When assembled, the liner ring (30) abuts the bottom end of the connecting ring (40). Finally, the tip (24) is threadingly connected to the liner ring (30) by mating a male thread (26) formed on a top portion of the tip (24) and a female thread (32 formed on an inner surface of the liner ring (30).

From the above description, it is noted that the invention has the following advantages:

1. decorative. The 3-dimensional pattern (11) formed on the pen can enhance the appearance of the pen.
2. commercial cause. The 3-dimensional pattern (11) can be a trademark or a logo which can provide commercial meanings.
3. simplicity. The pen having the 3-dimensional pattern (11) thereon has a simple structure which is easy and convenient to manufacture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pen comprising a connecting ring with an annular flange formed on the connecting ring, a liner ring abutting a bottom end of the connecting ring, a tip threadingly connected to a bottom end of the liner ring, and a barrel clamped onto a top end of the connecting ring, wherein the improvement comprises:

a pattern ring abutting the annular flange to enclose the liner ring, the pattern ring having at least one through hole defined in a face of the pattern ring; and at least one flexible strip sandwiched between the pattern ring and the liner ring, the at least one flexible strip having at least one 3-dimensional pattern formed to correspond to the at least one through hole in the pattern ring so that the at least one 3-dimensional pattern is able to protrude out of the at least one through hole to enhance the appearance of the pen.

* * * * *